United States Patent [19]

Fanta et al.

[11] Patent Number: 5,034,584

[45] Date of Patent: Jul. 23, 1991

[54] SWITCH OPERATOR FOR SWITCHGEAR

[75] Inventors: Thomas O. Fanta, Melrose Park; Joel A. Ramos, Chicago, both of Ill.

[73] Assignee: S&C Electric Company, Chicago, Ill.

[21] Appl. No.: 411,425

[22] Filed: Sep. 22, 1989

[51] Int. Cl.[5] ..... H01H 3/04

[52] U.S. Cl. ..... 200/329; 74/625; 200/321; 200/332; 200/17 R

[58] Field of Search ..... 200/43.01, 43.11, 43.16, 200/321, 322, 329, 332, 335, 501, 17 R, 148 F, 81.5; 335/68, 74, 76; 74/625; 192/71

[56] References Cited

U.S. PATENT DOCUMENTS

| | | | |
|---|---|---|---|
| 1,146,446 | 8/1915 | Pongrat | 137/614.2 |
| 2,228,466 | 1/1941 | Ludwig et al. | 335/74 |
| 2,432,955 | 12/1947 | Wallace et al. | 200/43.16 |
| 2,864,477 | 12/1958 | Hollyday et al. | 192/71 |
| 3,508,179 | 4/1970 | Bernatt et al. | 335/68 |
| 3,806,684 | 4/1974 | Hauser | 335/76 |
| 4,107,486 | 2/1978 | Evans | 200/48 R |
| 4,190,755 | 2/1980 | Rogers | 200/334 |
| 4,351,994 | 9/1982 | Evans et al. | 200/400 |
| 4,466,520 | 8/1984 | Herman | 192/28 |
| 4,804,809 | 2/1989 | Thompson, Jr. et al. | 200/47 |

OTHER PUBLICATIONS

"S&C Switch Operator-Moto—Draulic Type", S&C Electric Company Photo Sheet 740-4.1, Sep. 23, 1968, 2 pgs.

"Switch Operating Mechanism", H. K. Porter Catalog No. 1-160, Apr. 1971, 4 pgs.

"MO-10 Motor Operator", I-T-E Imperial Corporation, Catalog Section 13.4.1.1-13.4.1.2, Aug. 30, 1986, 5 pgs.

"Type CM-4A Motor Operating Mechanism", Siemens-Allis Brochure DS 4.2, Jun. 1983, 8 pgs.

*Primary Examiner*—Henry J. Recla
*Assistant Examiner*—Glenn T. Barrett
*Attorney, Agent, or Firm*—James V. Lapacek

[57] ABSTRACT

A switch operator is provided that is capable of field retrofit installation by being affixed to manually operable switchgear to provide power operation thereof. The switch operator includes provisions for connecting the drive output of the switch operator to a switch-operating shaft of a manually operable switch within the switchgear. The drive output provisions of the switch operator include a selectively operable decoupling arrangement which is operable without the need for tools. The switch operator also provides for manual operation without the need for decoupling or the disconnection of parts. The drive output of the switch operator is defined at an output shaft of a motor/gear train. Two coaxially arranged levers, an operator drive lever and a switch drive lever, are selectively coupled to transmit the drive output of the switch operator to the switch-operating shaft. A manual drive connection is affixed to the output shaft which is rotatable to provide manual operation via a handle. The handle may be the same handle that is utilized for manual operation of the switch without the provision of the switch operator.

12 Claims, 3 Drawing Sheets

SWITCH OPERATOR FOR SWITCHGEAR

BACKGROUND OF THE INVENTION

1. Field of the Invention

The present invention relates generally to the field of switchgear and more particularly to a switch operator which may be installed either during manufacture or during retrofit to installed switchgear to provide power operation of manually operable switchgear, the switch operator including an arrangement for selective decoupling of the switch operator from the switch-gear that is operable without the need for tools and also providing for manual operation without the need to decouple or disconnect or remove any parts.

2. Description of the Related Art

Various switch operators and decoupling arrangements are known for switchgear and for high-voltage switches. For example, U.S. Pat. No. 4,804,809 is directed to a motor operator for switchgear. A sleeve (not shown) interconnects a connection shaft 80 to the operating shaft 40 of the switchgear operating mechanism. To effect manual operation, bolt 102 (FIGS. 6 and 7 of the '809 patent) is removed from the connecting shaft 80 to allow the drive element 94 to thereafter be separated from the end portion of the connecting shaft 80 along with the pin-like head 90 of the stud 88. Nex shown in FIG. 6, a wrench 126 is placed over the shaft 80 to perform the manual operation. The manual operation cannot be performed until the drive element 94 is removed to uncouple the clevis assembly 76 from the shaft 80. The removable drive element also permits the motor operator 46 to be tested independent of and without operation of the switchgear opening and closing mechanism. To summarize, manual operation requires decoupling. Additionally, the decoupling and manual operation each require the disassembly of parts.

Other decoupling arrangements for various apparatus are shown in the following U.S. Patents and publications: U.S. Pat. Nos. 1,146.446; 3,508,179; 4,107,486; 4,190,755; 4,351,994 and 4,466,520; S&C Electric Company Photo Sheet 740-4.1, Sept. 23, 1986., H. K. Porter Catalog No. 1-160, April 1971; I.T.E Imperial Corporation, Catalog Section 13.4.1.1-13.4.1.2, MO.10 Motor Operator, Aug. 30 1986; and Siemens-Allis Brochure DS 4.2. Type CM.4A Motor Operating Mechanism, June 1983.

While the aforementioned arrangements may be generally useful for their intended applications none of these arrangements is both generally suitable for retrofit in the field while also providing desirable drive configurations, decoupling arrangements and direct manual operation features which do not require the decoupling or disconnection of any parts.

SUMMARY OF THE INVENTION

Accordingly, it is a principal object of the present invention to provide a switch operator with an improved drive configuration and decoupling features.

It is another object of the present invention to provide a switch operator with improved manual operation without the need to decouple or disconnect parts.

It is a further object of the present invention to provide a decoupling arrangement for the selective decoupling of a switch operator from switchgear wherein the decoupling arrangement is operable without the need for tools.

These and other objects of the present invention are efficiently achieved by the provision of a switch operator that is capable of field retro-fit installation by being affixed to manually operable switchgear to provide power operation thereof. The switch operator includes provisions for connecting the drive output of the switch operator to a switch-operating shaft of a manually operable switch within the switchgear. The drive output provisions of the switch operator include a selectively operable decoupling arrangement which is operable without the need for tools. The switch operator also provides for manual operation without the need for decoupling or the disconnection of parts. The drive output of the switch operator is defined output shaft of a motor/gear train. Two coaxially arranged levers, an operator drive lever and a switch drive lever, are selectively coupled to transmit the drive output of the switch operator to the switch-operating shaft. A manual drive connection is affixed to the output shaft which is rotatable to provide manual operation via a handle. The handle may be the same handle that is utilized for manual operation of the switch without the provision of the switch operator.

BRIEF DESCRIPTION OF THE DRAWING

The invention, both as to its organization and method of operation, together with further objects and advantages thereof, will best be understood by reference to the following specification taken in conjunction with the accompanying drawing in which.

DETAILED DESCRIPTION

Figure 1:
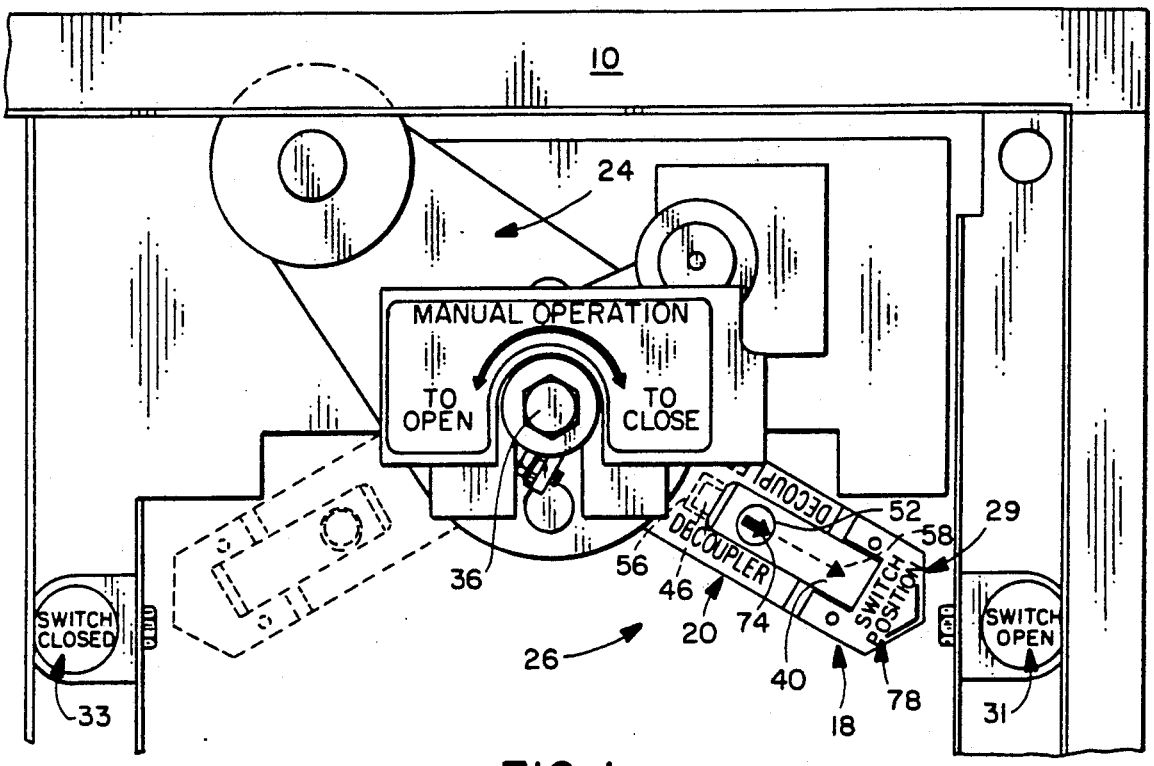
FIG. 1 is a front elevational view of portions of the switch operator of the present invention.
Figure 2:
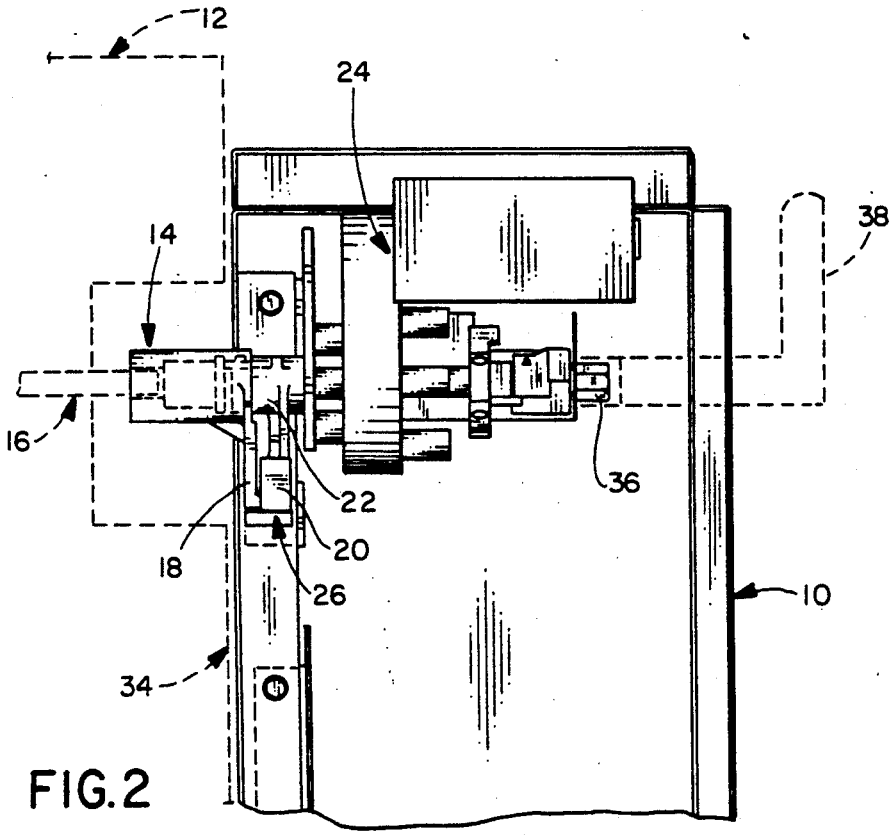
FIG. 2 is a side elevational view, with parts cut away for clarity, of the switch operator of FIG. 1.

Referring now to FIGS. 1 and 2, the switch operator 10 of the present invention provides power operation of a switch within switchgear generally referred to at 12 (FIG. 2) via rotation of a switch-operating shaft 16. The output 14 of the switch operator 10 is coupled to the switch-operating shaft 16 via a first lever 18, which may be referred to as a switch drive lever. Rotation of the first lever 18 is effected via rotation of a second lever 20 which is selectively coupled to the first lever 18 and which is coaxially disposed thereto. The second lever 20 may be referred to as an operator drive lever. The second lever 20 is affixed to an output shaft 22 of a motor/gear train 24 of the switch operator 10. A decoupling arrangement referred to generally at 26 is manually operable to selectively couple or decouple the first and second levers 18,20. Such decoupling is useful when it is desired to exercise the switch operator to confirm operability without changing the switch position. The decoupling arrangement 26 is operable without the need for tools to decouple the switch levers 18,20 in either the switch-open or switch-closed position. It should be understood that once the levers 18,20 are decoupled, the switch drive lever 18 remains fixed while the operator drive lever 20 may be moved to any position.

Figure 3:
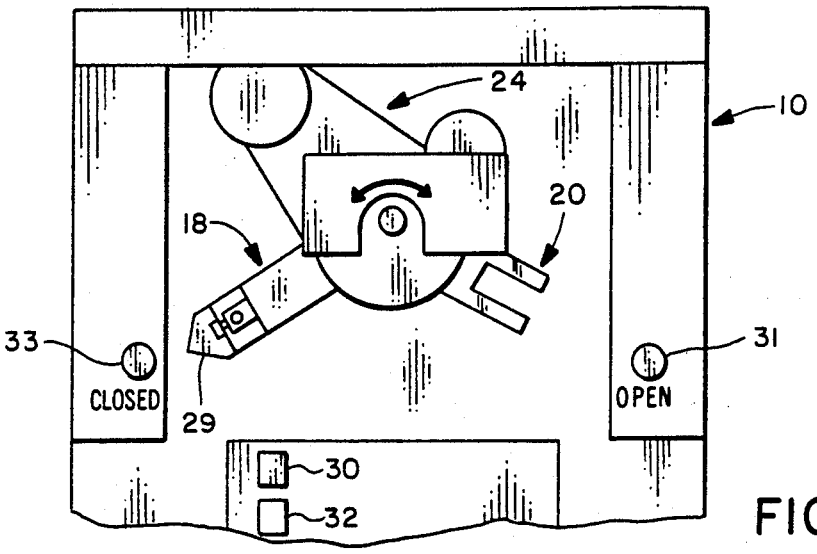
FIG. 3 is an elevational view of the switch operator of FIG. 1 with the drive arrangement in a decoupled position.
Figure 4:
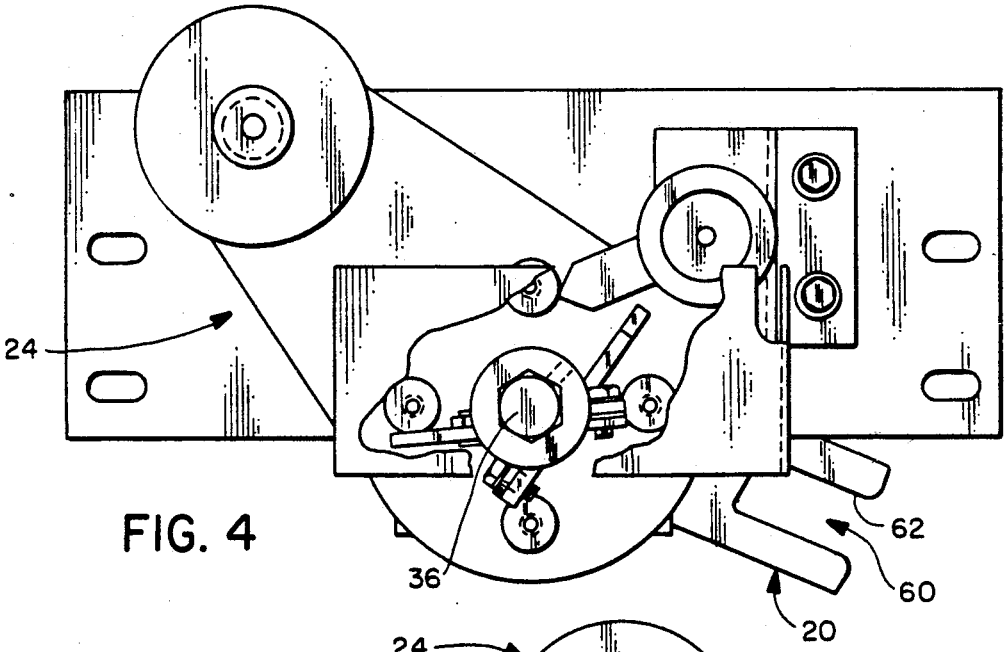
FIGS. 4 and 5 are front and rear elevational views, respectively, of the switch operator of FIG. 1 with parts removed and parts cut away for clarity.
Figure 5:
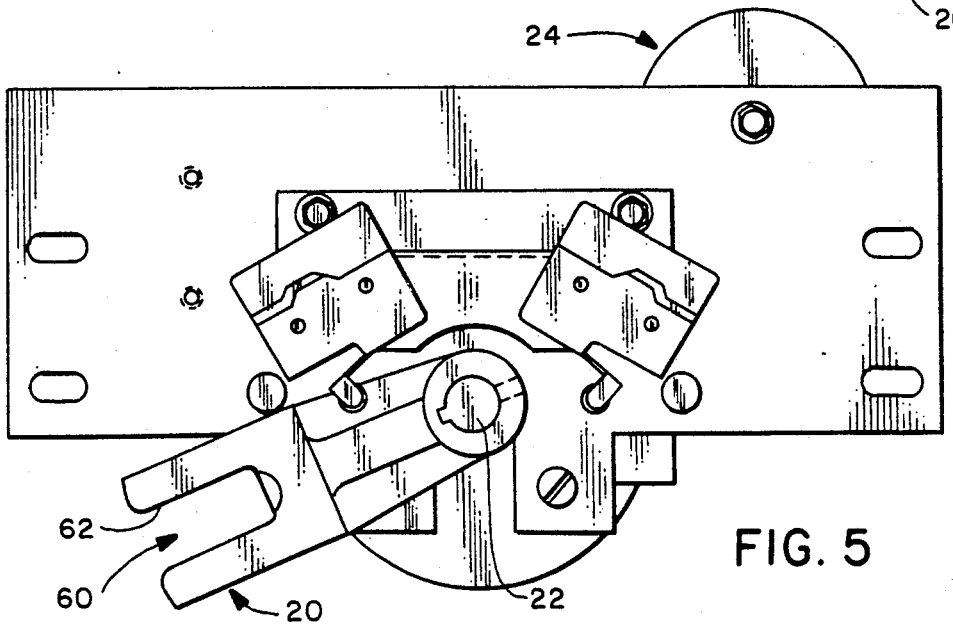

In an illustrative example, and referring now additionally to FIG. 3, the levers are shown after the decoupling of the levers in the switch-closed position and after the operation of the switch operator to move the second lever from the switch-closed position to the switch-open position—the first drive lever 18 remaining in the switch-closed position.

Local operation is provided via open-close. pushbuttons 30,32. The condition of the switch is indicated by the respective open-close targets 31,33 and the position of an indicator pointer 29 that is carried at the end of the first drive lever 18.

The switch operator 10 is supported by the enclosure 34 of the switchgear 12 and may be affixed thereto either during manufacture of the switchgear or as a field retrofit operation, all as described in more detail in copending U.S. application Ser. No. 07,411,274 filed in the names of T. Fanta et al on Sept. 22, 1989 to which reference may be made. Thus, addition of the switch operator 10 to the switchgear provides the capability of power operation to the manually operable switchgear. Additionally, a manual operating hub 36 (e.g., hex head in FIG. 1) can be ro via a manual operating handle 38 (phantom position in FIG. 2) for manual operation of the switch-operating shaft in the event that such is desired or necessary. For simplicity, the manual operating hub 36 has the same cross section as the switch operating shaft 16. Thus the manual operating handle 38 can be utilized for both purposes.

Figure 6:
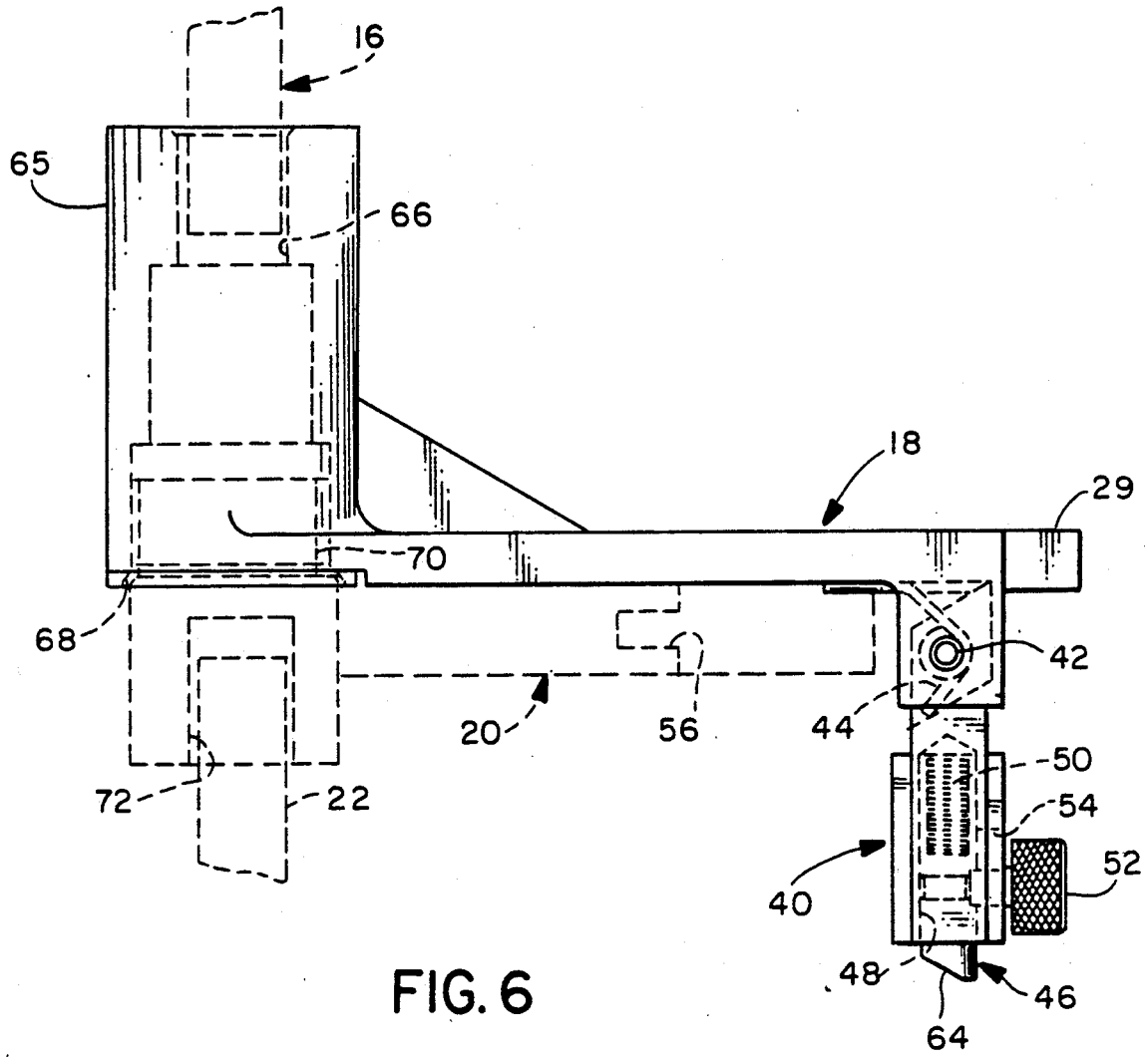
FIG. 6 is an elevational view of the switch drive lever of the switch operator of FIG. 1.
Figure 7:
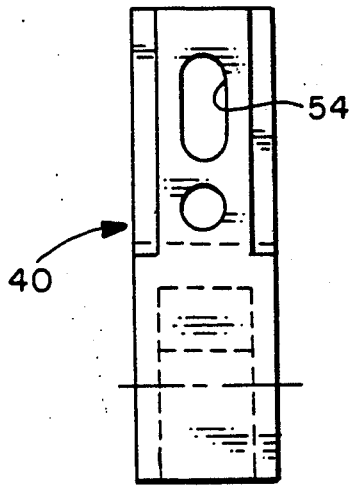
FIG. 7 is an elevational view of a portion of the decoupling arrangement carried by the switch drive lever of FIG. 6.

Considering now the decoupling arrangement 26 in more detail and referring additionally to FIGS. 6 and 7, the first lever 18 carries a decoupling latch arm or member 40 that is pivotally mounted about a pivot pin 42. A spring 44 is disposed around the pivot pin 42 to bias the decoupling latch arm 40 away from the first lever 18. A latch plunger 46 is slidably disposed within a passage 48 of the latch arm 40. A coil spring 50 is disposed about the latch plunger 46 to bias the latch plunger 46 out of the latch arm 40. A knob 52 is affixed to the latch plunger 46 and is movable within slot 54 of the latch arm 40 so as to effect movement of the latch plunger 46 against the bias of the spring 50 and toward the pivot pin 42 to accomplish decoupling of the first and second levers 18,20. Specifically, a latch receiver cavity 56 is provided in the second lever 20 into which the latch plunger 46 is received. To accomplish decoupling, the knob 52 is moved in the direction 58 which slides the latch plunger out of the cavity 56 and free of the second lever 20.

When the latch plunger 46 is free of the second lever 20, the decoupling latch arm 40 is pivoted away from the plane of the levers 18,20 to a position approximately perpendicular to the levers 18,20. In this position, the levers 18,20 are decoupled while the switch operator may be activated either by power operation or manually without changing the position of the switch drive lever 18 or the condition of the switch-operating shaft 16.

In the illustrative example of FIG. 3, the operator drive lever 20 is moved, for example, from the switch-closed position to the switch-open position as illustrated while the switch drive lever 18 remains in the switch-closed position.

As can be seen in FIG. 3, the operator drive lever 20 at the end thereof defines a passage 60 via side walls 62—the latch arm 40 being received within the slot or passage 60 such that the arm 40, when coupled, bears against the side walls to impart motion to the drive lever 18 when the drive lever 20 is rotated. As can be seen in FIG. 2, the bottom surface of the lever 20 is parallel to and in close proximity to the upper surface of the lever 18.

To accomplish coupling of the levers 18,20 so as to again be able to drive the switch-operating shaft 16 from the switch operator 10, the operator drive lever 20 is moved into alignment with the switch drive lever 18 via either the pushbuttons or the manual operating handle 38. For movement of the operator drive lever 20 to the exact alignment position, it is convenient to use the manual handle 38 to rotate the operating hub 36 until appropriate alignment is achieved. Then, the latch arm 40 is pivoted until the latch plunger 46 moves into latching engagement with the drive lever 20. To this end and to facilitate movement of the latch plunger into the cavity 56, the end of the latch plunger 46 includes a beveled or tapered leading edge 64 or other suitably contoured surface. At this point. the levers 18,20 are again coupled for power operation of the switchgear via the switch operator 10.

As shown in FIG. 6, the cylindrical output-coupling portion 65 of the lever 18 includes a first socket portion 66 that is defined with a predetermined cross section to accept the switch-operating shaft 16, e.g. hexagonal. Additionally, the coupling portion 65 includes a bearing socket 68 which is defined to receive and support a bearing surface 70 of the drive lever 20. A central sleeve portion 72 of drive lever 20 includes a passage for affixing of the output shaft 22 via a key, set screw, etc.

For facility of use, the decoupler knob 52 carries arrow indicia 74 to indicate the direction of operation 58. The end of the lever 18 via the indicator pointer 29 forms an indicator along with indicia 78 disposed thereon for alignment with the targets 31,33.

While there have been illustrated and described various embodiments of the present invention, it will be apparent that various changes and modifications will occur to those skilled in the art. It is intended in appended claims to cover all such changes and modifications as fall within the true spirit and scope of the present invention.

What is claimed and desired to be secured by Letters Patent of the United States is:

1. An arrangement for selectively driving a switch-opening shaft from an operator output, the arrangement comprising:

a switch drive lever affixed to the switch-operating shaft for rotation thereof;

an operator drive lever coupled to an operator output and rotatable therewith;

said levers being arranged such that the shaft and the operator output are coaxial and said levers are disposed generally parallel to each other; and means carried by a first of said levers for selectively coupling/decoupling said levers such that rotation of said operator output is selectively coupled to rotate the switch-operating shaft, said selective coupling/decoupling means comprising a first member movably mounted with respect to said first of said levers and being movable to a first coupled position to impart motion from said first lever to said second of said levers, means for biasing said first member away from said first coupled position, and manually operable means carried by said movable with respect to said first member of releasably securing said first member to said second lever in said first coupled position, whereby operation of said manually operable means releases said first member from said second member such that said first member in response to said biasing means moves out of said first coupled position so as to decouple said two levers.

2. The arrangement of claim 1 wherein said manually operable means comprises a second member slidably carried by said first member, said second lever including means for cooperating with said second member and receiving a first portion of said second member via inter-engagement of said first portion and said cooperating and receiving means.

3. The arrangement of claim 2 wherein said second lever includes a portion that defines spaced-apart walls, said first member in said first coupled position coating with said spaced-apart walls to impart force from said first lever to said second lever.

4. The arrangement of claim 3 wherein said cooperating and receiving means comprises a passage within said second lever.

5. The arrangement of claim 3 wherein said second means further comprises a third member extending from said second member.

6. An arrangement for selectively driving a switch-operating shaft from an operator output, the arrangement comprising:

a switch drive lever affixed to the switch-operating shaft for rotation thereof;

an operator drive lever coupled to an operator output and rotatable therewith;

said levers being arranged such that the shaft and the operator output are coaxial and said levers are disposed generally parallel to each other; and means carried by a first of said levers for selectively coupling/decoupling said levers such that rotation of said operator output is selectively coupled to rotate the switch-operating shaft, said operator drive lever carrying a drive shaft coupled to said operator output, said drive shaft including predetermined tool-receiving means.

7. The arrangement of claim 6 wherein said tool-receiving means has a predetermined cross section identical to the switch-operating shaft.

8. An arrangement for selectively driving a switch-operating shaft from an operator output, the arrangement comprising:

a switch drive lever affixed to the switch-operating shaft for rotation thereof;

an operator drive lever coupled to an operator output and rotatable therewith;

said levers being arranged such that the shaft and the operator output are coaxial and said levers are disposed generally parallel to each other; and means carried by a first of said levers for selectively coupling/decoupling said levers such that rotation of said operator output is selectively coupled to rotate the switch-operating shaft, said levers being movable between two predetermined positions.

9. The arrangement of claim 8 wherein one of said two levers carries means for providing an indicium.

10. The arrangement of claim 9 further comprising switch-condition indicating means being disposed adjacent said indicium providing means at said two predetermined locations.

11. An arrangement for selectively driving a switch-operating shaft from an operator output, the arrangement comprising:

a switch drive lever affixed to the switch-operating shaft for rotation thereof;

an operator drive lever coupled to an operator output rotatable therewith;

said levers being arranged such that the shaft and the operator output are coaxial and said levers are disposed generally parallel to each other; and means carried by a first of said levers and cooperating with the second of said two levers for selectively coupling/decoupling said levers such that rotation of said operator output is selectively coupled to rotate the switch-operating shaft, said selective coupling/decoupling means comprising first means movable to a first position to impart motion from said first lever to said second of said levers and second means for maintaining said first means in said first position and being actuable to cause said first means to move out of said first position whereby said two levers are decoupled, said first means comprising a first member and said second means comprising a second member slidably carried by said first member.

12. The arrangement of claim 11 wherein said second means further comprises means for biasing said first member away from said first position.

* * * * *

UNITED STATES PATENT AND TRADEMARK OFFICE

CERTIFICATE OF CORRECTION

PATENT NO. : 5,034,584

DATED : July 23, 1991

INVENTOR(S) : Thomas O. Fanta et al

It is certified that error appears in the above-identified patent and that said Letters Patent is hereby corrected as shown below:

Col. 1, line 13, "switch-gear" should be -- switchgear -- (no hyphen);
line 28, "Nex" should be -- Next, as --;
line 45, "MO.10" should be -- MO-10 --;
line 47, "CM.4A" should be -- CM-4A --;
line 50, after "applications" insert -- , -- (comma);
Col. 2, line 3, "retro-fit" should be -- retrofit -- (no hyphen);
line 14, after "defined" insert -- at an --;
line 34, "," (comma, second occurrence) should be --;-- (semicolon);
line 37, "," (comma) should be -- ; -- (semicolon);
Col. 3 line 21, "07,411,274" should be -- 07/411,274 --;
line 27, "ro" should be -- rotated --;
Col. 4, line 44, after "in" (second occurrence) insert -- the --;
line 52 (claim 1, line 2), "opening" should be -- operating --;
Col. 5, line 2, "said" should be -- and --;
line 3, "of" should be -- for --;
line 20 (claim 3, line 3), "coating" should be -- coacting --;
Col. 6, line 27 (claim 11, line 6), after "output" insert -- and --.

Signed and Sealed this

Fifteenth Day of December, 1992

*Attest:*

DOUGLAS B. COMER

*Attesting Officer*

*Acting Commissioner of Patents and Trademarks*